US008096831B2

(12) United States Patent
Hsu et al.

(10) Patent No.: US 8,096,831 B2
(45) Date of Patent: Jan. 17, 2012

(54) ELECTRICAL CONNECTOR HAVING ROBUST INTERENGAGEMENT ARRANGED BETWEEN CONTACTS AND HOUSING

(75) Inventors: Kuo-Chun Hsu, Tu-Cheng (TW); Min-Han Lin, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/883,186

(22) Filed: Sep. 16, 2010

(65) Prior Publication Data

US 2011/0065325 A1 Mar. 17, 2011

(30) Foreign Application Priority Data

Sep. 16, 2009 (TW) ..... 098131253

(51) Int. Cl.
*H01R 13/648* (2006.01)

(52) U.S. Cl. ..... 439/607.01

(58) Field of Classification Search ..... 439/607.01, 439/607.05, 660, 638, 736
See application file for complete search history.

(56) References Cited

U.S. PATENT DOCUMENTS

| | | | | |
|---|---|---|---|---|
| 4,682,840 | A * | 7/1987 | Lockard | 439/874 |
| 4,826,443 | A * | 5/1989 | Lockard | 439/101 |
| 5,797,770 | A * | 8/1998 | Davis et al. | 439/607.27 |
| 6,219,913 | B1 * | 4/2001 | Uchiyama | 29/883 |
| 6,375,474 | B1 * | 4/2002 | Harper et al. | 439/66 |
| 7,364,463 | B1 * | 4/2008 | Ju | 439/607.55 |
| 7,364,464 | B2 * | 4/2008 | Iino et al. | 439/607.55 |
| 7,473,143 | B2 * | 1/2009 | Chen | 439/670 |
| 7,481,677 | B1 | 1/2009 | Yi et al. | |
| 7,497,732 | B2 * | 3/2009 | Yi | 439/607.23 |
| 7,572,157 | B2 * | 8/2009 | Zhu | 439/862 |
| 7,883,371 | B1 * | 2/2011 | Chen et al. | 439/607.41 |
| 2004/0097128 | A1 * | 5/2004 | Wu | 439/567 |
| 2004/0157491 | A1 * | 8/2004 | Lin | 439/607 |
| 2004/0180577 | A1 * | 9/2004 | Zhang | 439/607 |
| 2007/0298658 | A1 * | 12/2007 | Iino et al. | 439/607 |
| 2010/0203768 | A1 * | 8/2010 | Kondo et al. | 439/676 |
| 2010/0248552 | A1 * | 9/2010 | He et al. | 439/638 |

* cited by examiner

*Primary Examiner* — Michael Zarroli
*Assistant Examiner* — Vladimir Imas
(74) *Attorney, Agent, or Firm* — Andrew C. Cheng; Wei Te Chung; Ming Chieh Chang

(57) ABSTRACT

An electrical connector includes a base portion defining a receiving cavity, a tongue plate portion retained in the receiving cavity and a first set of contacts retained in the tongue plate portion. The tongue plate portion defines a mating portion projecting out of the at least one receiving cavity for mating with a plug connector and receiving grooves thereon. The first set of contacts includes four first contacts each defining a retaining portion received in a corresponding receiving groove and retained in the receiving cavity, a contacting portion extending forwards from a front end of the retaining portion and a mounting portion. The retaining portion defines a pair of wings bending upwards from two side edges thereof and projecting out of the receiving groove, and the base portion defines corresponding pressing portions projecting to and pressing the wings.

20 Claims, 12 Drawing Sheets

ELECTRICAL CONNECTOR HAVING ROBUST INTERENGAGEMENT ARRANGED BETWEEN CONTACTS AND HOUSING

BACKGROUND OF THE INVENTION

1. Field of the Invention

The present invention relates to an electrical connector, and more particularly to an electrical connector securely retaining the contact during mating and disengaging with a mating component.

2. Description of the Related Art

Electrical connectors are typically used to couple PCB (Printed Circuit Board) which have numerous electrical devices. U.S. Pat. No. 7,481,677 issued to Yi et al. on Jan. 27, 2009 discloses a universal serial bus (USB) connector which defines an insulative housing, a plurality of contacts retained in the housing and a metal shell enclosing the housing. The housing defines a base portion and two stacked tongues extending forwards from the base portion. Each tongue defines a plurality of receiving grooves recessed from a bottom face thereof and further running through the base portion. The plurality of contacts each is received in a corresponding receiving groove and retained to the housing by the barbs projecting outwards from the retaining portion engaging with opposite side faces of the receiving groove. However, an electrical connector suitable for miniaturization will make the housing be thinner and thinner, and the bards engaging with the housing will broken the housing easily. On the other hand, the retaining portion is hard to attach to the top face of the receiving groove and a space will be provided therebetween, which may weaken the retaining efficacy between the contact and the housing. Hence, it is desired to provide an electrical connector to overcome the problems mentioned above.

SUMMARY OF THE INVENTION

An object of the present invention is to provide an electrical connector having improved retaining interengagement between contacts and housing.

In order to achieve the above-mentioned object, an electrical connector includes a base portion defining at least one receiving cavity, a tongue plate portion retained in the at least one receiving cavity and a first set of contacts retained in the tongue plate portion. The tongue plate portion defines a mating portion projecting out of the at least one receiving cavity for mating with a plug connector and receiving grooves thereon. The first set of contacts includes at least one first contact defining a retaining portion received in a corresponding receiving groove and retained in the at least one receiving cavity, a contacting portion extending forwards from a front end of the retaining portion and a mounting portion extending from a rear end of the retaining portion. The retaining portion defines at least one wing bending upwards from each side edge thereof and projecting out of the receiving groove, and the base portion defines at least one pressing portion projecting to and pressing the at least one wing.

Other objects, advantages and novel features of the invention will become more apparent from the following detailed description of the present embodiment when taken in conjunction with the accompanying drawings.

DETAILED DESCRIPTION OF THE INVENTION

Figure 1:
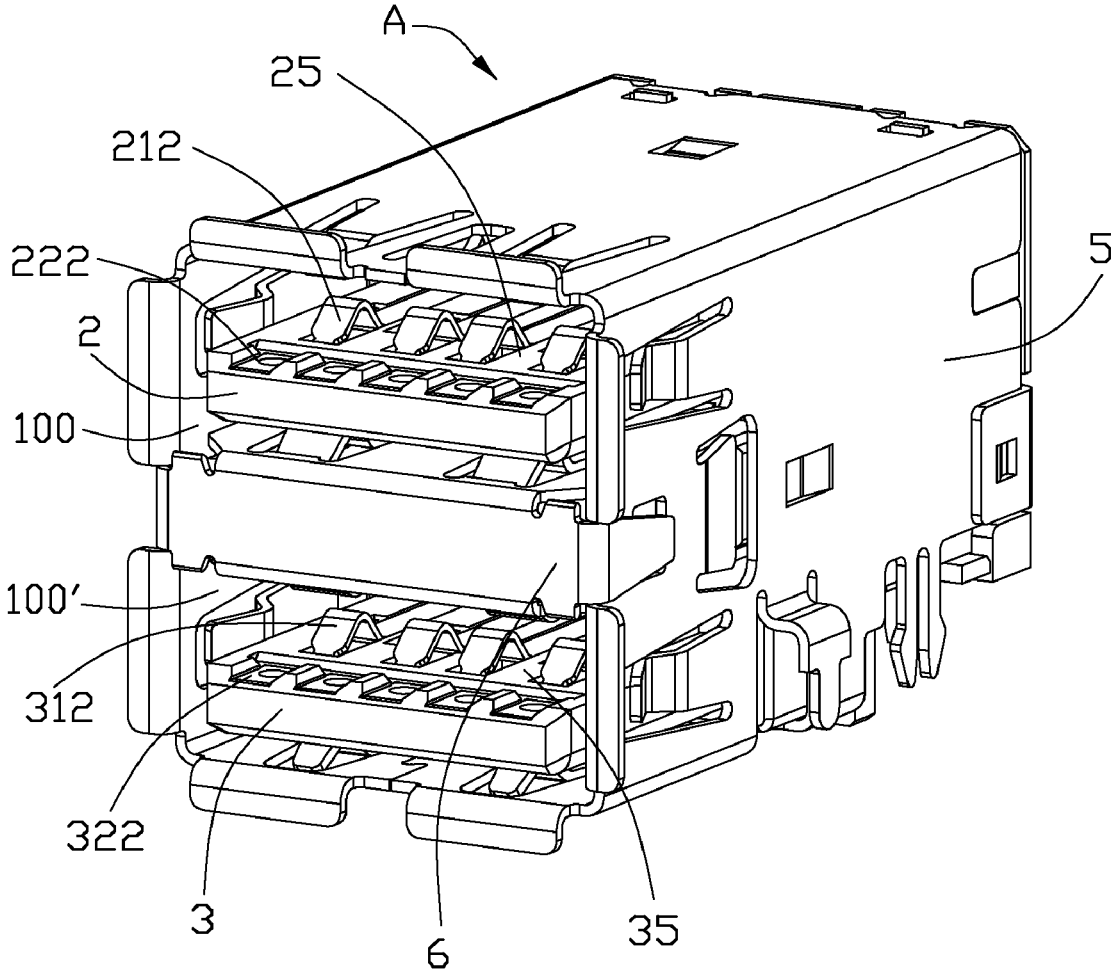
FIG. 1 is an assembled, perspective view of an electrical connector in accordance with the present invention.

Reference will now be made to the drawing figures to describe the preferred embodiment of the present invention in detail.

Figure 10:
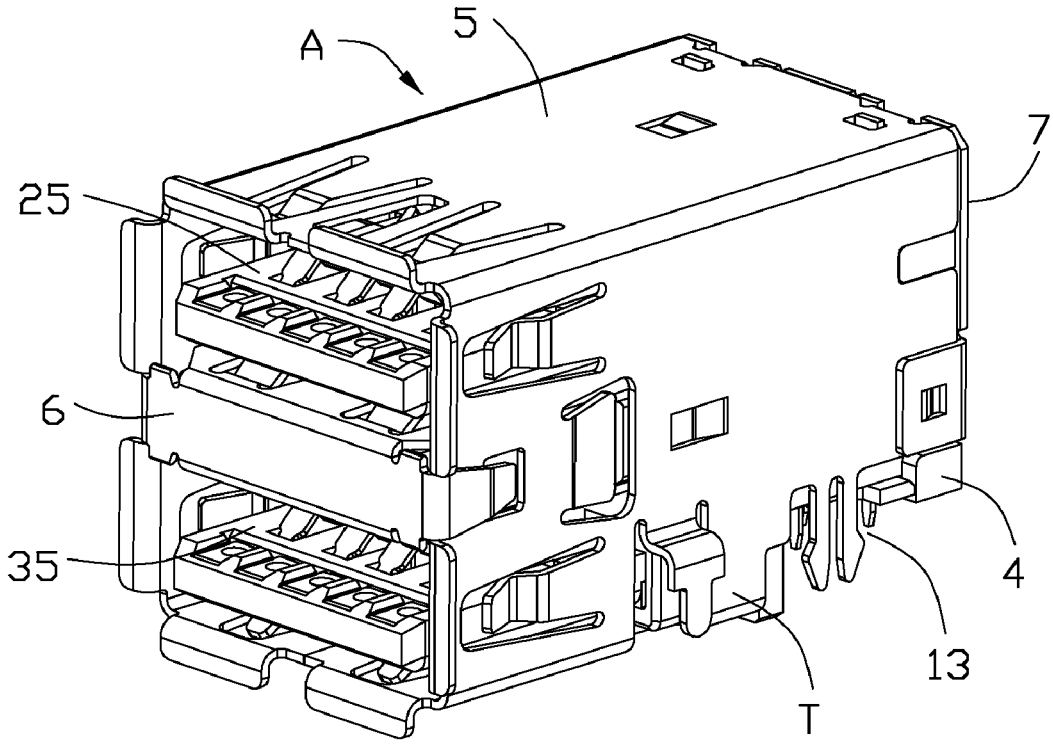
FIG. 10 is a perspective view of the electrical connector shown in FIG. 1 separated with a printed circuit board.
Figure 10:
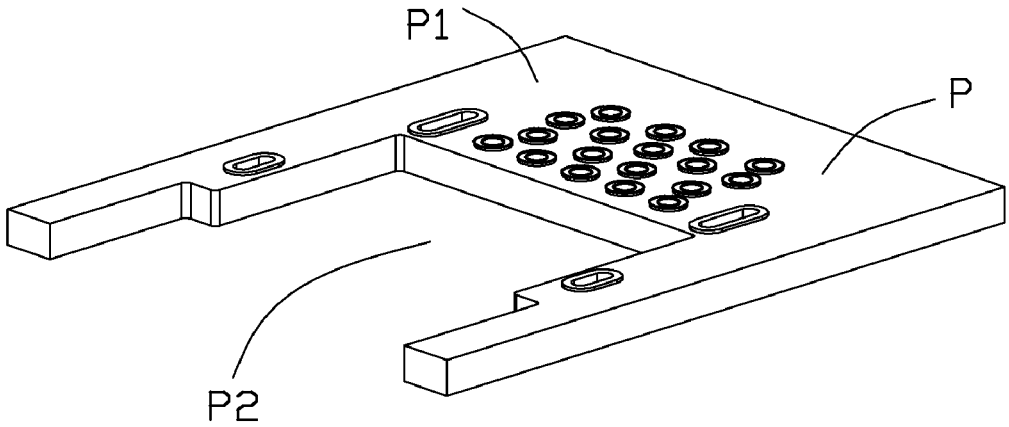
Figure 11:
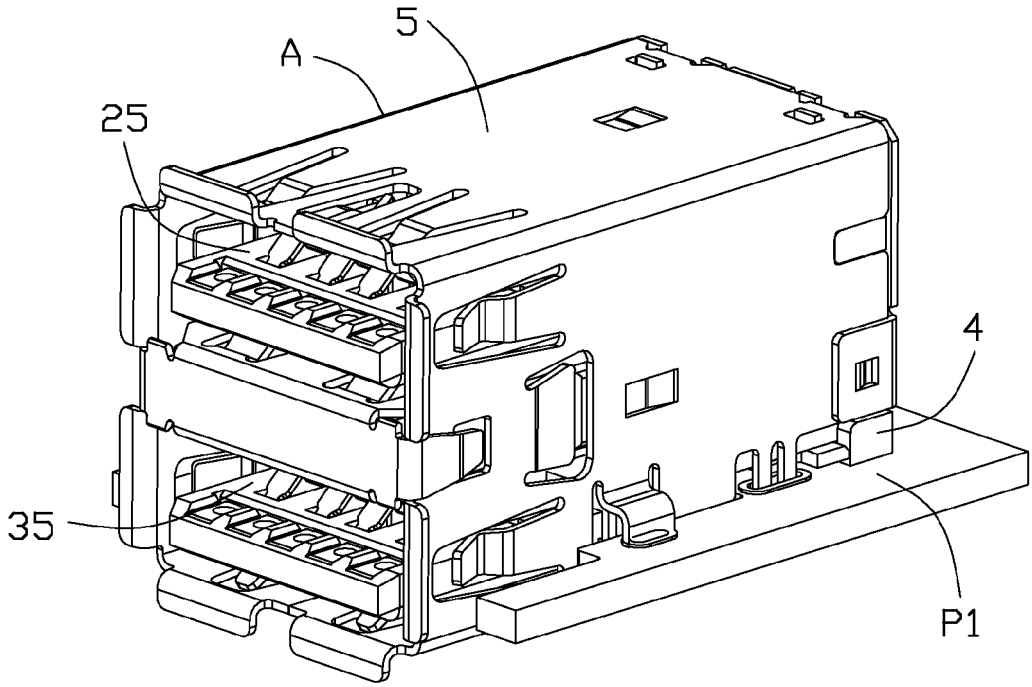
FIG. 11 is a perspective view of the electrical connector assembled to the printed circuit board shown in FIG. 10.
Figure 12:
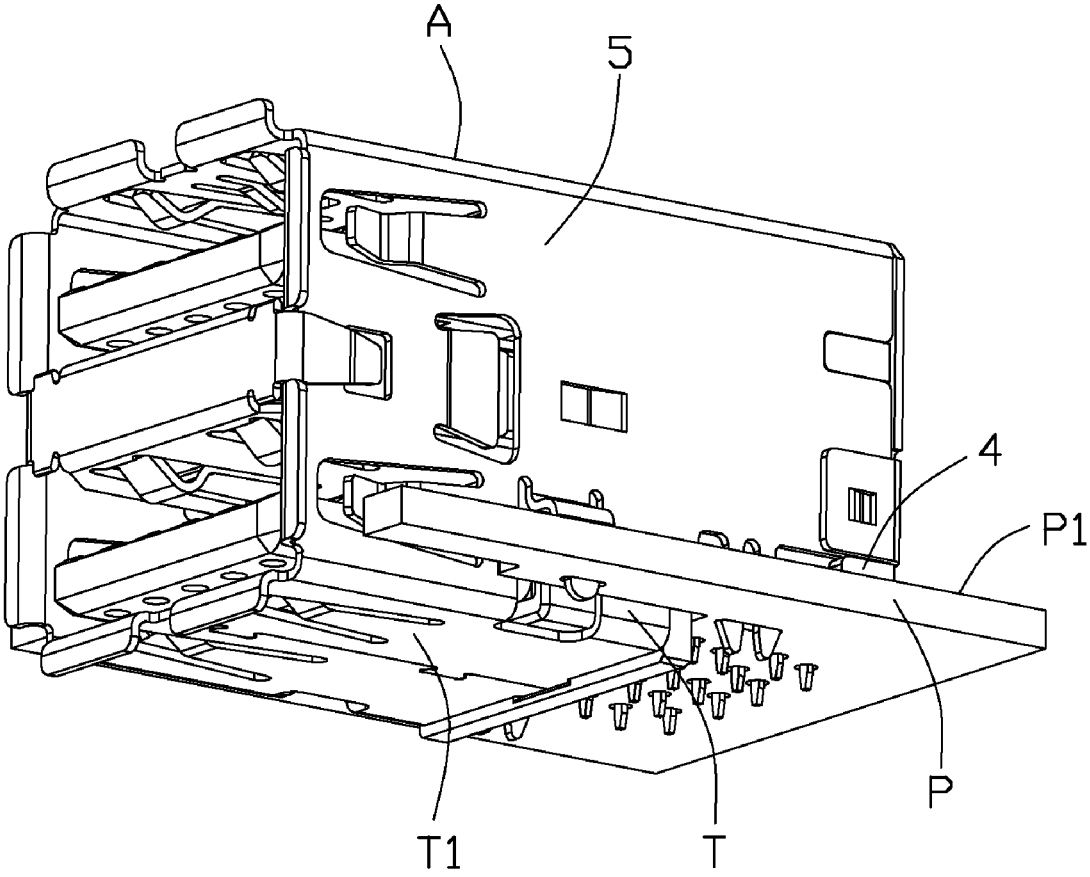
FIG. 12 is another perspective view of the electrical connector assembled to the printed circuit board shown in FIG. 11.

Referring to FIGS. 1 to 4, an electrical connector A to be mounted on a printed circuit board P (PCB, shown in FIG. 10) is disclosed. The electrical connector A mainly includes an insulative housing, a first and second sets of contacts retained in the housing and metal shields enclosing the insulative housing. The insulative housing shown in the preferred embodiment includes a separate base portion 1 and a pair of first/upper and second/lower tongue plate portions 2, 3 fixed to the base portion 1, which will be detailedly described hereinafter. The metal shields enclose the upper and lower tongue plate portions 2, 3 to form a first and a second receiving opening 100, 100' therebetween.

The drawings of the preferred embodiment show a stacked electrical connector with two receptacles. However, it is easy to understand that the present invention could be used with any type of electrical connector. While each receptacle is shown with nine contacts 21, 22 therein, the invention can be employed with any desired number of contacts. Similarly, the invention can be employed with a single receptacle or any desired number of stacked receptacles.

Referring to FIGS. 3 to 8, the rectangular base portion 1 includes a first/upper receiving cavity 10, a second/lower receiving cavity 10' and a separated extending portion 11 extending forwardly from a front surface 100 of the base portion 1 to separate the upper and lower receiving cavities 10, 10'. Each upper or lower receiving cavity 10, 10' defines a slot 101, 101' for receiving the tongue plate portions 2, 3 and a plurality of passageways 102, 102' communicating with the corresponding slot 101, 101' for allowing the first and third contacts 21, 31 passing through. The base portion 1 further includes a rear surface 103 with the passageways 102, 102' extending through the front and rear surfaces 100, 103.

Figure 3:
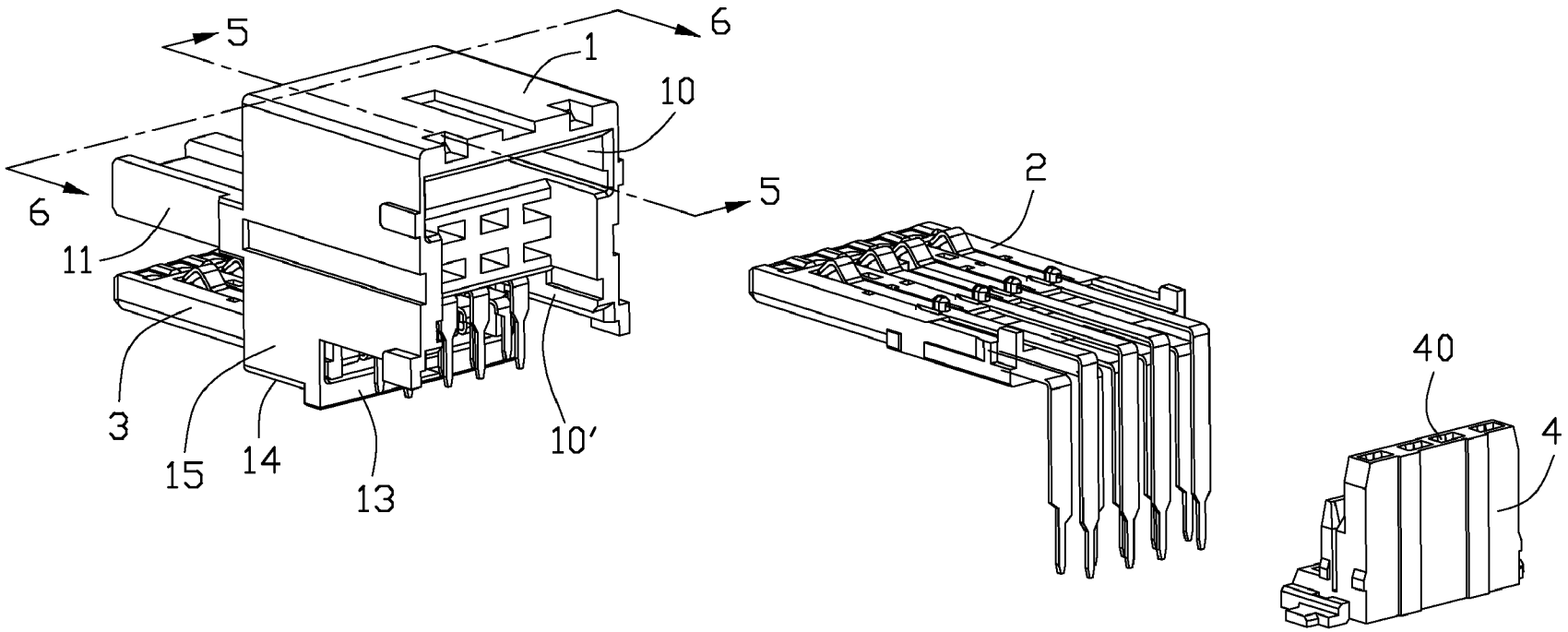
FIG. 3 is a part exploded perspective view of the electrical connector shown in FIG. 1 with the shells removed.
Figure 4:
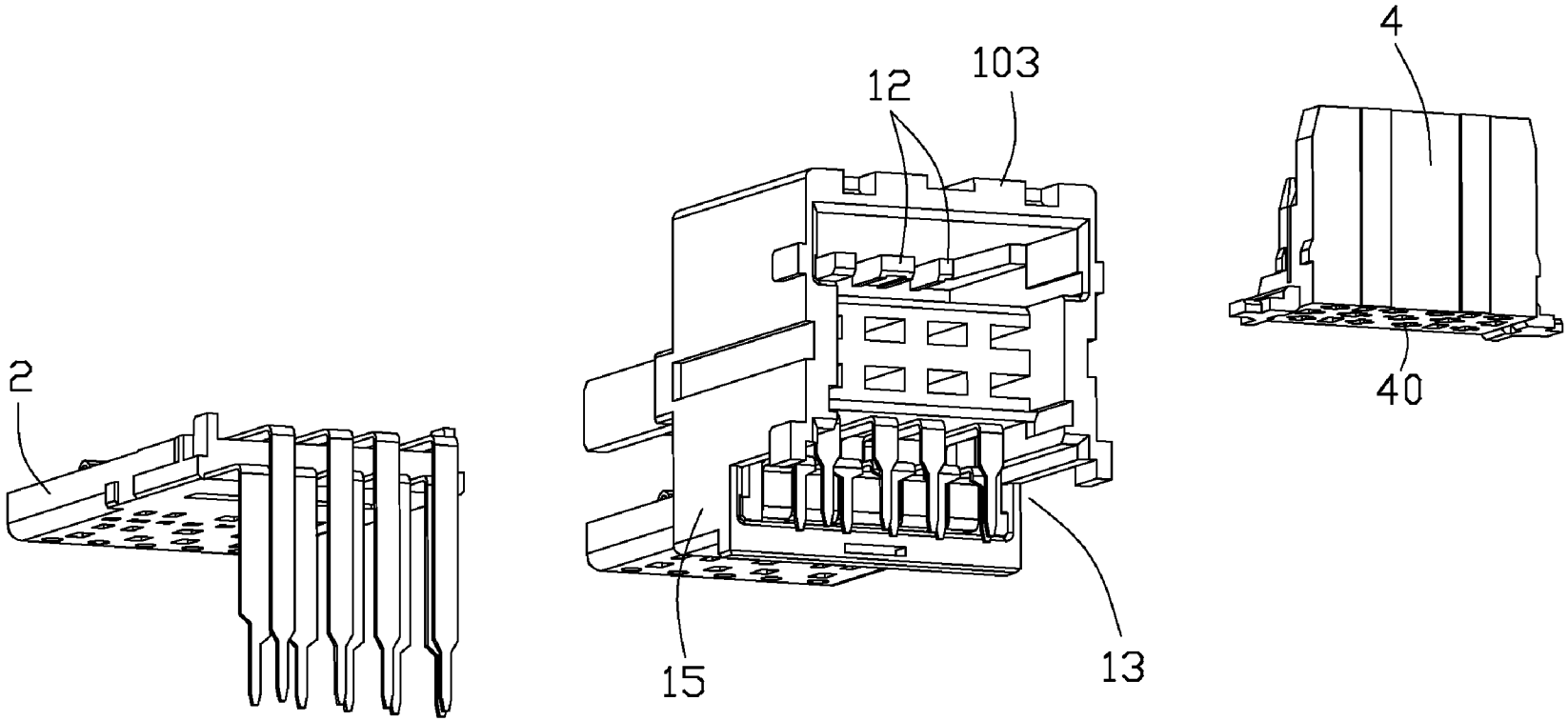
FIG. 4 is another part exploded perspective view of the electrical connector shown in FIG. 3.
Figure 5:
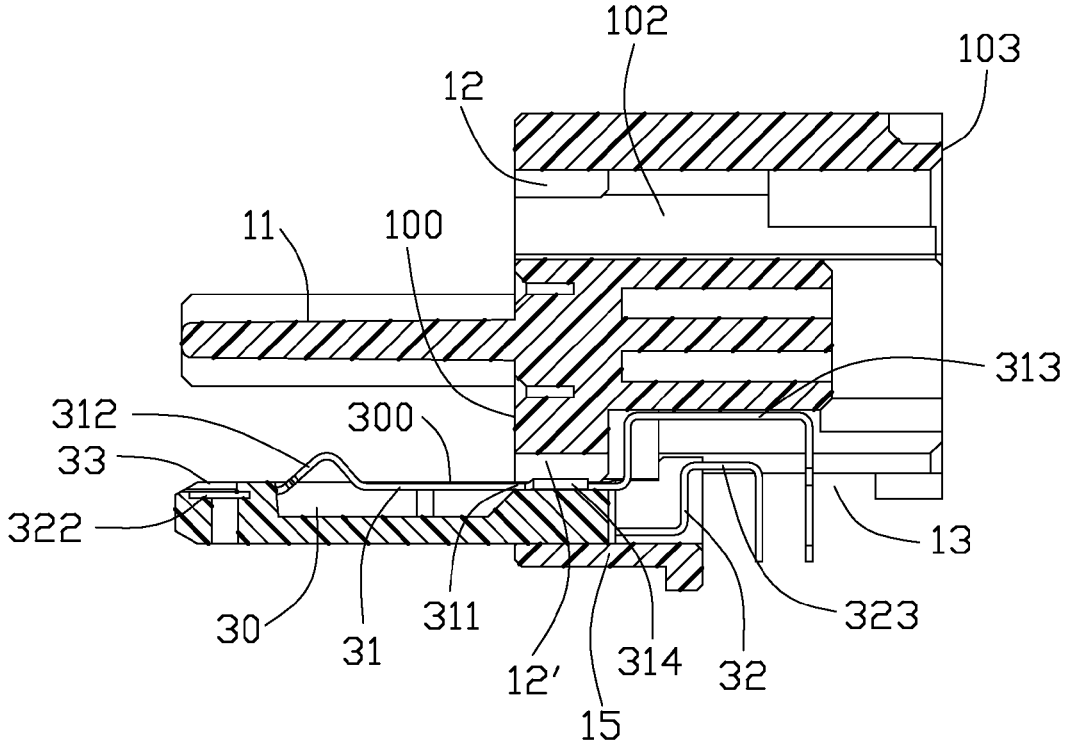
FIG. 5 is a cross-sectional view of the electrical connector taken along line 5-5 of FIG. 3.
Figure 6:
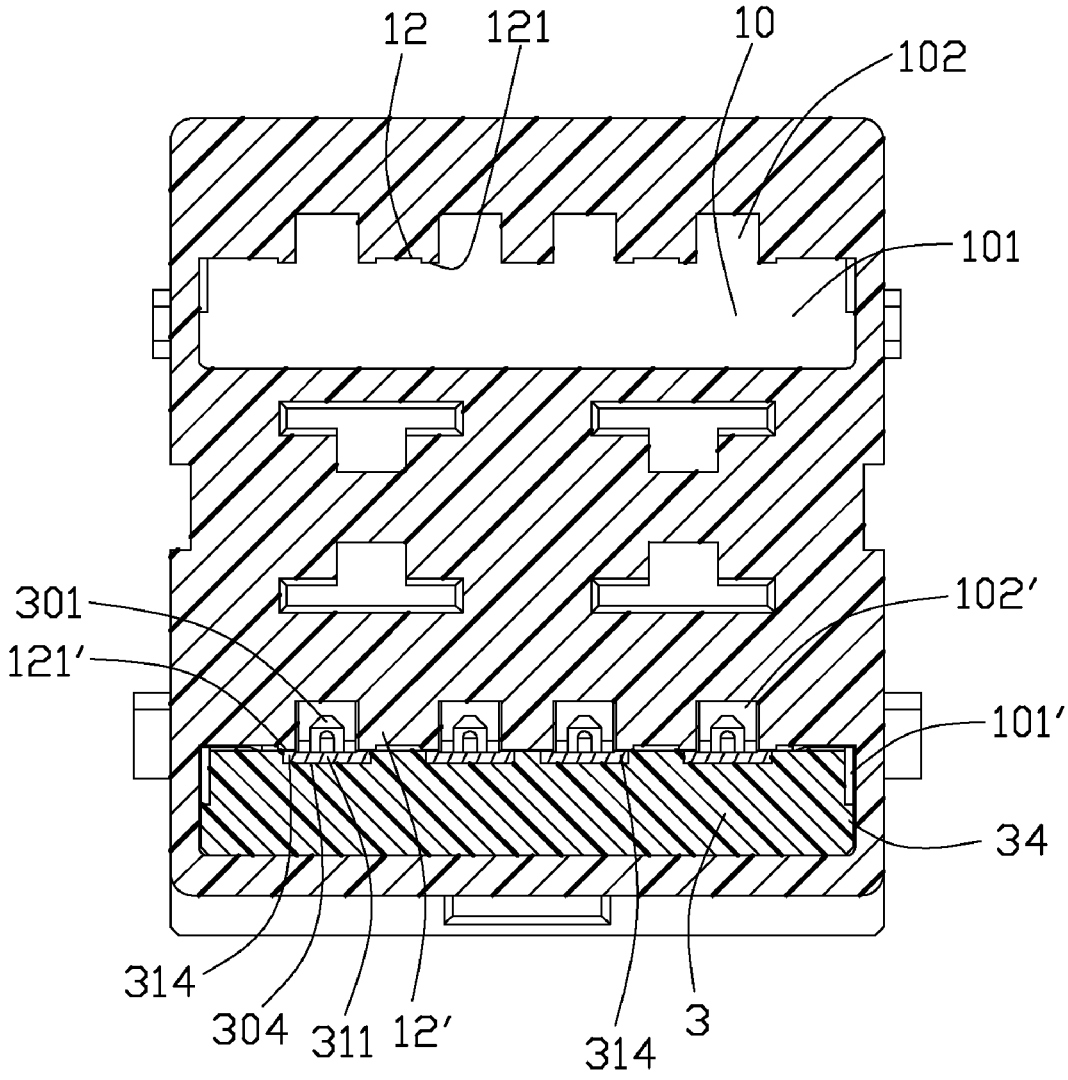
FIG. 6 is a cross-sectional view of the electrical connector taken along line 6-6 of FIG. 3.
Figure 7:
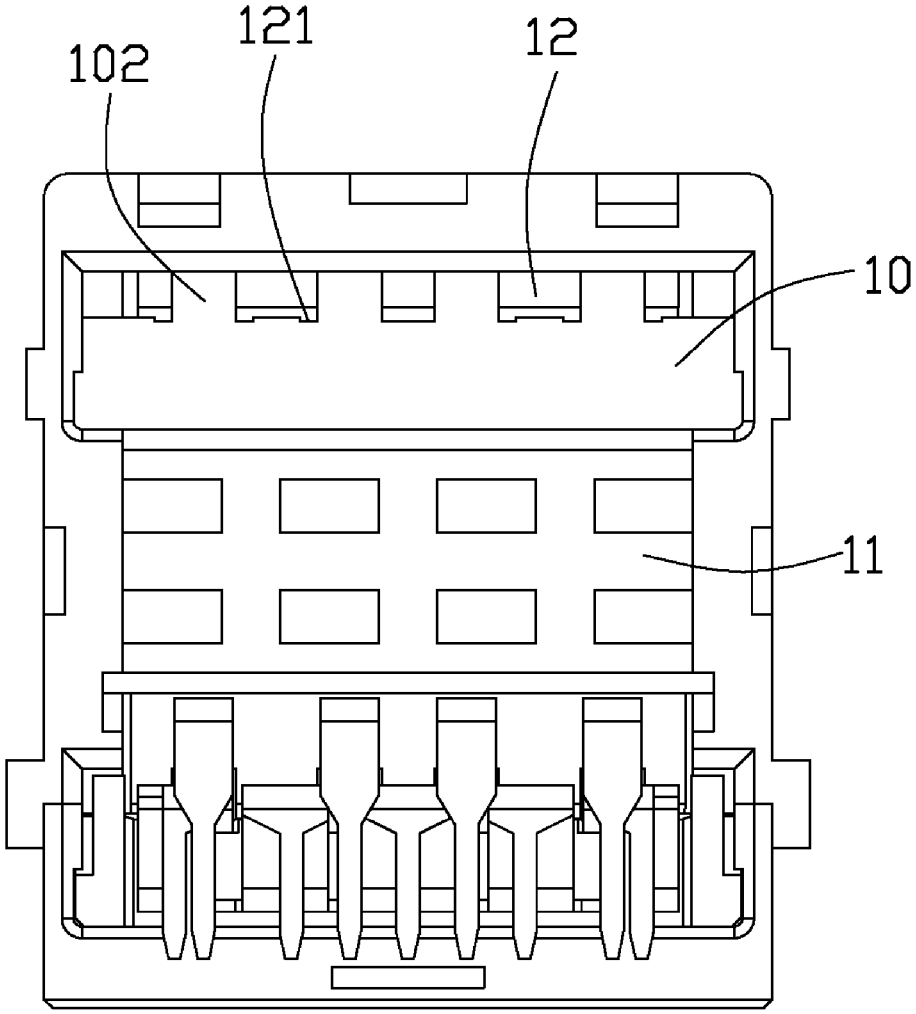
FIG. 7 is a rear elevational view of a second/lower tongue plate portion assembled to the housing.

Referring to FIGS. 4 to 6, the base portion 1 provides a plurality of pressing portions 12 disposed between every two adjacent passageways 102 in the first receiving cavity 101. Each pressing portion 12 further defines at least one protrusion 121 extending downwards from a side portion adjacent to the passageways 102 and projecting into the first receiving cavity 101. The base portion 1 also provides pressing portions 12' which have a similar configuration as the pressing portions 12 in the second receiving cavity 101'. The pressing portions 12' each defines at least one protrusion 121' projecting into the second receiving cavity 101'. Referring to FIGS. 3 to 6, the base portion 1 defines a receiving portion 13 at a rear and bottom portion thereof. The receiving portion 13 recesses upwards from a bottom face 14 of the base portion 1 at a rear portion thereof, and the front bottom portion of the base portion 1 disposed in front of the receiving portion 13 is defined as a projection portion 15.

Figure 8:
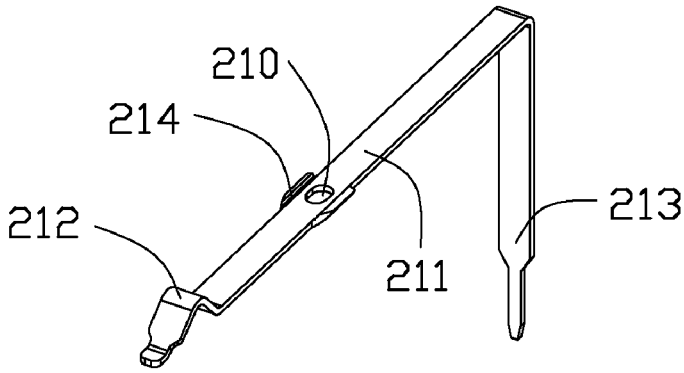
FIG. 8 is a perspective view of a first/upper tongue plate portion retaining a first set of contacts thereof.
Figure 8:
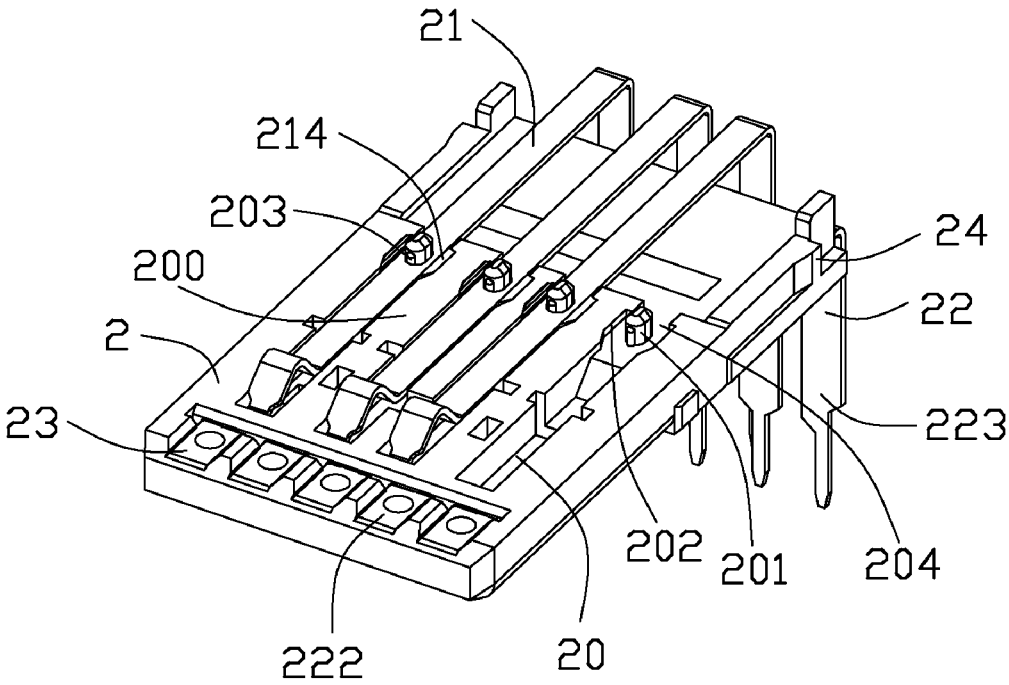
Figure 9:
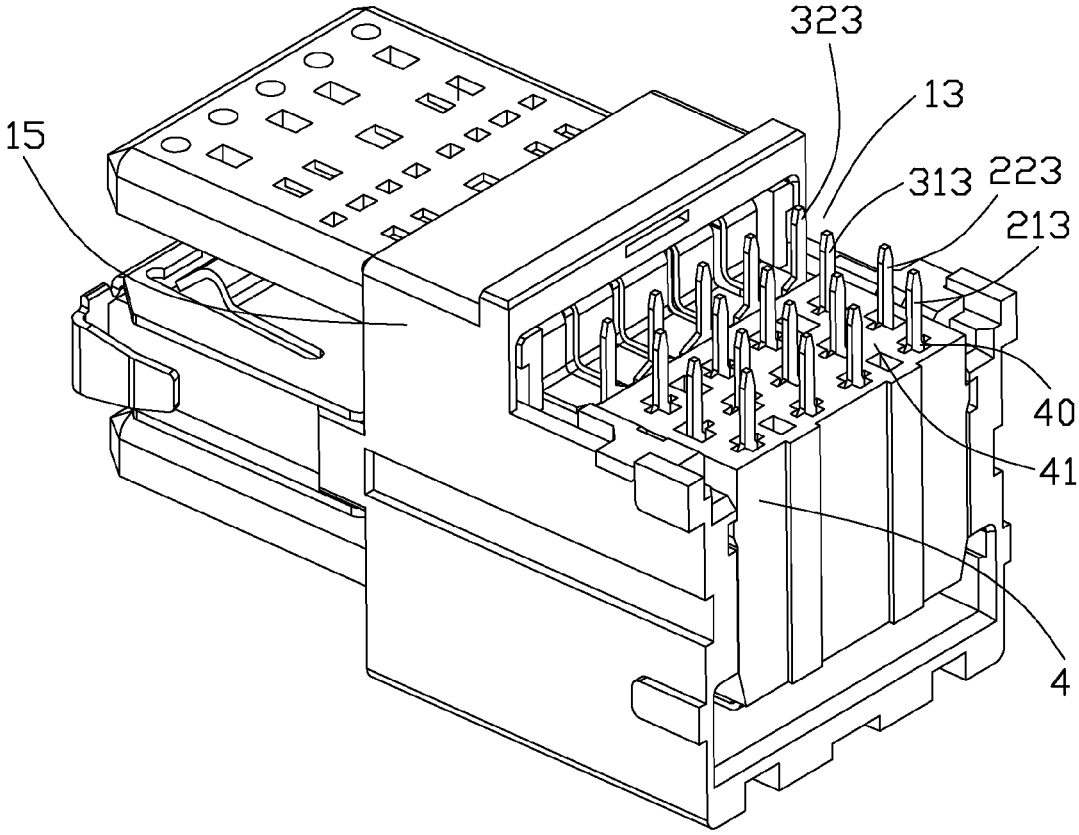
FIG. 9 is another perspective view of the electrical connector shown in FIG. 1 with the shells removed.

Referring to FIG. 8, the first tongue plate portion 2 defines a top face 200, four receiving grooves 20 corresponding to the passageways 102 and five receiving openings 23 close to a front edge. Each receiving groove 20 defines a retaining post/dowel 201 projecting upwards from a bottom face 204 thereof and two opposite receiving slot 202 respectively recessed outwards from opposite side faces thereof. The receiving slots 202 is around the retaining post 201, and each retaining post 201 defines two protrusions 203 oppositely projecting in a front-to-rear direction.

In this preferable embodiment, the first set of contacts includes four first contacts 21 and five second contacts 22. The first contacts 21 are inserted into the first tongue plate portions 2 downwardly and each defines a retaining portion 211, an elastic contacting portion 212 extending forwards from a front end of the retaining portion 211 for mating with a plug contact of a mating plug, and a mounting portion 213 extending downwardly from the rear end of the retaining portion 211 for mounting to the printed circuit board P. The retaining portion 211 defines a through hole 210 at a middle portion thereof and a pair of wings 214 bending upwards and disposed around the through hole 210. The first contacts 21 are arranged in the receiving grooves 20, and the retaining posts 201 each runs through a corresponding through hole 210 and with the protrusions 203 engaging with the inner edge of the through hole 210 to retain the first contact 21 to the first tongue plate portions 2. The wing 214 each is received in the receiving slot 202 and further extends upwards to beyond the top face 200.

Referring to FIG. 8, the second contacts 22 are inserted in the first tongue plate portions 2 by insert-molding and each includes a flat non-elastic contacting portion 222 received and exposed in the receiving openings 23 and a mounting portion 223 extending downwardly and out of the first tongue plate portions 2. The contacting portions 212, 222 of the first contacts 21 and second contacts 22 are located on the top face 200 of the first tongue plate portion 2 and staggered along the front-to-rear direction. The contacting portions 222 of the second contacts 22 are arranged closer to a front edge of the first tongue plate portions 2 than the contacting portions 212 of the first contacts 21. The contacting portions 212, 222 also are staggered along a vertical direction thereby to mate with the contacts of the plug at different height.

Referring to FIG. 5 and FIG. 6, the second tongue plate portion 3 has a same configuration as the first tongue plate portion 2 and defines a top face 300, four retaining posts/dowels 301 projecting from the receiving grooves 30 corresponding to the passageways 102' and five receiving openings 33 close to a front edge. The second set of contacts includes four third contacts 31 and five fourth contacts 32. The third contact 31 each has a similar configuration as the first contact 21 and also defines a retaining portion 311 and a pair of wings 314 bending upwards and beyond the top faces 300, except that the mounting portion 313 of the third contact 31 extends upwards and then downwards. The fourth contact 32 each has a similar configuration as the second contact 22, except that the mounting portion 323 of the fourth contact 32 extends upwards and then downwards. The contacting portions 312, 322 of the third and fourth contacts 31, 32 are located on the top face 300 of the second tongue plate portion 3 and staggered along the front-to-rear direction. The contacting portions 322 of the fourth contacts 32 are arranged closer to a front edge of the second tongue plate portions 3 than the contacting portions 312 of the third contacts 31. The contacting portions 312, 322 also are staggered along the vertical direction thereby to mating with contacts of a plug at different height.

Referring to FIG. 2 to FIG. 9, the first and second tongue plate portions 2, 3 retaining corresponding first and second sets of contacts therein, both are assembled to the base portion 1 from the rear face 103 thereof. The first tongue plate portion 2 is retained in the first receiving cavity 10 by the protrusions 24 provided in a rear portion of the side faces engaging with the inner surface of the first receiving cavity 10. Similarly, the second tongue plate portion 3 is retained in the second receiving cavity 10' by the protrusions 34 provided in a rear portion of the side faces engaging with the inner surface of the second receiving cavity 10'. As shown in FIG. 6, each retaining post/dowel 301 runs through the retaining portion 311 and into the passageways 102' to prevent the third contact 31 from moving in the front-to-rear direction, and each protrusion 121' extending from the pressing portion 12' downwardly presses the corresponding wing 314 to make the retaining portion 311 attaching to the bottom face 304 of the receiving groove 30 and prevent the retaining portion 311 from moving in the vertical direction. Similarly, the wings 214 of the first contact 21 are also pressed by the corresponding protrusions 121 extending from the pressing portion 12 downwardly, and the retaining portion 211 of the first contact 21 attaches to the bottom face 204 of the receiving groove 20. Therefore, the first and second contacts 21, 31 are retained securely. The mounting portions 213, 223, 313, 323 are received in the receiving portion 13.

Figure 2:
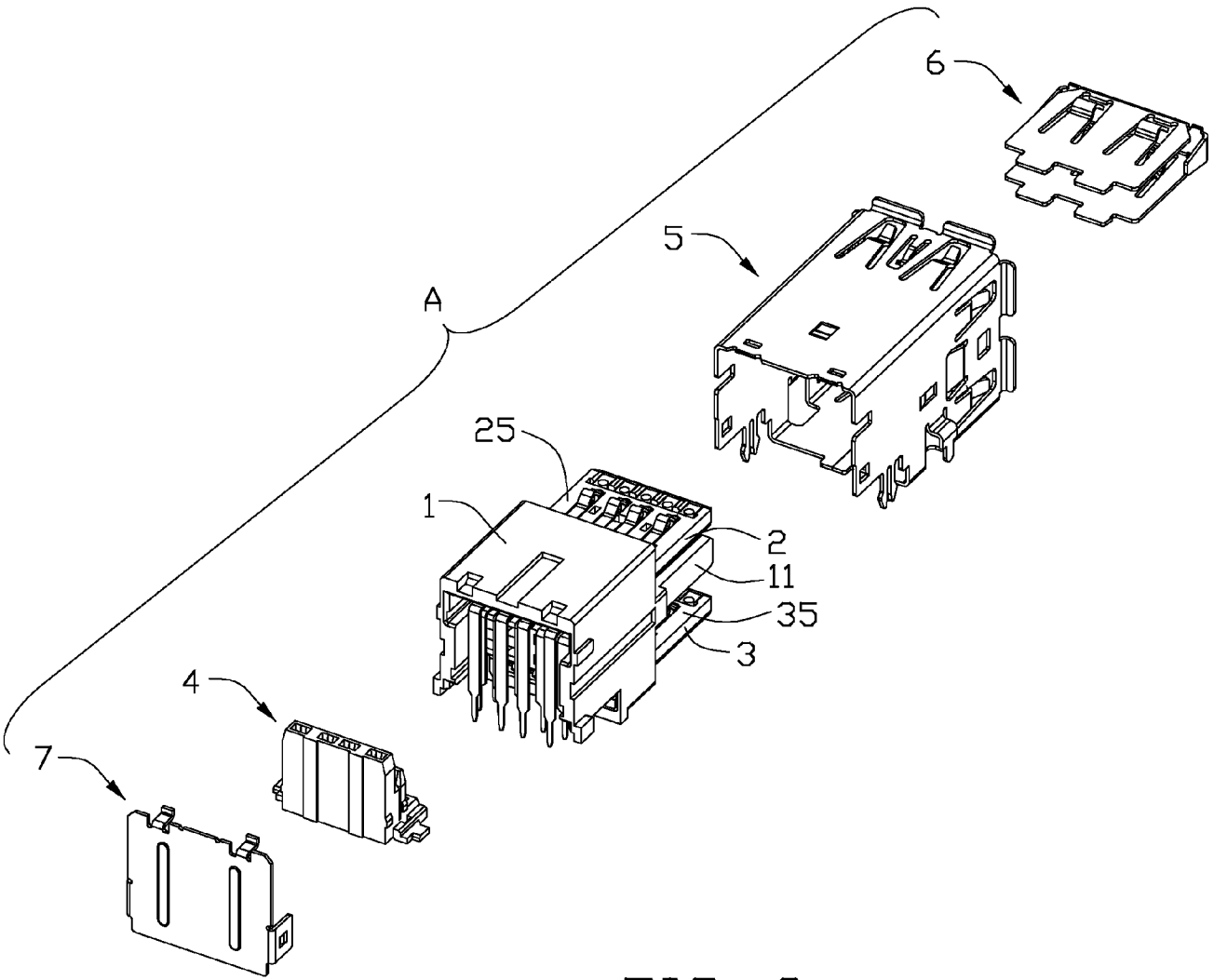
FIG. 2 is a part exploded perspective view of the electrical connector shown in FIG. 1.

Referring to FIG. 1 and FIG. 2, a front portion of the first tongue plate portion 2 which carries the contacting portions 212, 222 of the first set of contacts forwardly runs through the first receiving cavity 10 and projects beyond the front face 100 of the base portion 1 to provide a first mating portion 25. Similarly, a front portion of the second tongue plate portion 3 which carries the contacting portions 312, 322 of the second set of contacts is defined as a second mating portion 35. The first mating portion 25 is disposed in the first receiving opening 100 and parallel to the extending portion 11, and the second mating portion 35 is disposed in the second receiving opening 100' and parallel to the extending portion 11.

In order to organize all the mounting portions 213, 223, 313, 323 in preliminary position, the electrical connector A further comprise a spacer 4 fixed to the receiving portion 13 of the base portion 1. As shown in FIGS. 3 and 4, the spacer 4 defines a plurality of retaining holes 40 arranged in three parallel rows, and all the mounting portions 213, 223, 313 of the first, second and third contacts 21, 22, 31 respectively extend through the retaining holes 40 so that the mounting portions 213, 223, 313 can be easily soldered to the PCB.

Referring to FIG. 1 and FIG. 2, the metal shields includes a first/outer shell 5 enclosing the base portion 1, a second/inner shell 6 enclosing the extending portion 11 and a rear/third shell 7 enclosing the rear face 103 of the base portion 1. Referring to FIG. 9 to FIG. 12, the electrical connector is assembled to a printed circuit board P having a top face P1 and a cutout P2 at a side edge thereof. The electrical connector A is assembled to the printed circuit board P by the bottom face 41 of the spacer 4 supported by the top face P1 of the printed circuit board P and the projection portion 15 enclosed by the first shell 5 passing through the cutout P2. The projection portion 15 enclosed by the first shell 5 is defined as a projecting protrusion T of the electrical connector A, and the bottom face 41 of the spacer 4 is defined as a mounting face of the electrical connector A. The projecting protrusion T runs through the printed circuit board P and defines a bottom face T1 disposed lower than the top face P1 of the printed circuit board P and the mounting face 41 of the electrical connector A, which can reduce the space disposed above the printed circuit board P for receiving the electrical connector A.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a base portion defining at least one receiving cavity;

a tongue plate portion retained in the at least one receiving cavity and defining a mating portion projecting out of the at least one receiving cavity for mating with a plug connector, the tongue plate portion having receiving grooves thereon;

a first set of contacts retained in the tongue plate portion, including at least one first contact defining a retaining portion received in a corresponding receiving groove and retained in the receiving cavity, a contacting portion extending forwards from a front end of the retaining portion and a mounting portion extending from a rear end of the retaining portion;

wherein the retaining portion defines at least one wing bending upwards from each side edge thereof and projecting out of the receiving groove, and the base portion defines at least one pressing portion projecting to and pressing the at least one wing.

2. The electrical connector as described in claim 1, wherein the at least one receiving cavity defines a slot for receiving the tongue plate portion and at least one passageways communicating with the corresponding slot for allowing the contacting portion of the at least one first contact passing through, and the at least one pressing portion is disposed at one side of the at least one passageways.

3. The electrical connector as described in claim 2, wherein the at least one pressing portion further defines at least one protrusion extending downwards from a side portion adjacent to the passageways and projecting into the slot, and the at least one protrusion presses the at least one wing.

4. The electrical connector as described in claim 1, wherein at least one of the receiving grooves defines a retaining post projecting upwards from a bottom face thereof, and the retaining post runs through a retaining hole disposed at the retaining portion of the at least one first contact.

5. The electrical connector as described in claim 4, wherein the retaining post defines two protrusions oppositely projecting in a front-to-rear direction.

6. The electrical connector as described in claim 4, wherein the at least one receiving cavity defines a slot for receiving the tongue plate portion and at least one passageways communicating with the corresponding slot for allowing the contacting portion of the at least one first contact passing through, and the retaining post is disposed in the at least one passageways.

7. The electrical connector as described in claim 1, wherein the at least one receiving groove defines at least one receiving slot recessed outwards for receiving the at least one wing.

8. The electrical connector as described in claim 1, wherein the first set of contacts include at least one second contact having a contacting portion, the contacting portions of the at least one first and second contacts expose on a same face of the tongue plate portion, and the contacting portion of the at least one second contact is arranged closer to a front edge of the first tongue plate portion than the contacting portion of the at least one first contact.

9. The electrical connector as described in claim 1, wherein a bottom face of the electrical connector is provided lower than a mounting face of the electrical connector.

10. The electrical connector as described in claim 1, wherein the first set of contacts and the tongue plate are configured to have the first set of contacts assembled to the tongue plate in a vertical direction while allowing the tongue plate associated with the first set of contacts to be commonly assembled to the base portion in a forward direction perpendicular to said vertical direction under condition that the wings are located in the receiving cavity when the tongue plate is fully assembled to the housing.

11. The electrical connector as described in claim 10, further including a second set of contacts configured to be integrally formed with the tongue plate with stiff type contacting sections in front of resilient type contacting sections of the first set of contacts.

12. The electrical connector as described in claim 10, wherein the base portion defines a plurality of passageways communicatively adjacent to said receiving cavity to respectively receive retaining posts on the tongue plate which is used to retain the first set of contacts to the tongue plate.

13. An electrical connector assembled to a printed circuit board having a cutout at a side edge thereof, comprising:

an insulative housing having a first and second mating portions stacked in a vertical direction;

a first set of contacts retained in the first mating portion, including four first contacts and five second contacts each defining a contacting portion, the contacting portions of the first and second contacts staggered along a front-to-rear direction in a same face of the first mating portion, and the contacting portions of the second contacts arranged closer to a front edge of the first mating portion than the contacting portions of the first contacts;

a second set of contacts retained in the second mating portion, including four third contacts and five fourth contacts each defining a contacting portion, the contacting portions of the third and fourth contacts staggered along the front-to-rear direction in a same face of the second mating portion, and the contacting portions of the fourth contacts arranged closer to a front edge of the second mating portion than the contacting portions of the third contacts; and a first shell enclosing the housing;

wherein the electrical connector defines a mounting face supporting onto the printed circuit board and a projecting protrusion received in the cutout and providing a bottom face lower than the mounting face.

14. The electrical connector as described in claim 13, wherein the housing defines an extending portion disposed between the first and second mating portions.

15. The electrical connector as described in claim 13, wherein the housing includes a base portion defining a first and second receiving cavities, a first tongue plate portion retained in the first receiving cavity and a second tongue plate portion retained in the second receiving cavity, and the first set of contacts retained in the first tongue plate portion and the second set of contacts retained in the second tongue plate portion.

16. The electrical connector as described in claim 15, wherein a front portion of the first tongue plate portion carrying the contacting portions of the first set of contacts and extending out of the first receiving cavity is defined as the first mating portion, and a front portion of the second tongue plate portion carrying the contacting portions of the second set of contacts and extending out of the second receiving cavity is defined as the second mating portion.

17. The electrical connector as described in claim 16, wherein the first contacts are received in the receiving grooves disposed in the first tongue plate portion, and each receiving groove defines a retaining post projecting upwards from a bottom face thereof, and the retaining post runs through a retaining hole disposed at a retaining portion of the first contact.

18. The electrical connector as described in claim 17, wherein each first contact defines a pair of wings bending upwards from the retaining portion thereof, and the base portion defines pressing portions projecting to and pressing the wings.

19. An electrical connector, comprising:

an insulative housing having at least a receiving groove;

at least a contact disposed in the receiving groove; and interengaging engagement arranged between the receiving groove and the contact, and including an insulative dowel from the receiving groove, and an opening defined in the contact engaged with the dowel;

wherein each contact having a retaining portion secured in the receiving groove and a pair of wings at opposite edges of the retaining portion, the wings projecting out of the receiving groove for engaging with the insulative housing.

20. The electrical connector as described in claim 19, wherein said insulative housing is essentially a tongue plate which is configured to be inserted into a receiving cavity of a base portion in only a horizontal direction, which said receiving groove extends along and which is perpendicular to a vertical direction along which the dowel is inserted into the opening, and wherein a metallic shell further encloses the base portion and the tongue plate which extends further beyond the base portion in said horizontal direction.

* * * * *